United States Patent [19]

Rees

[11] Patent Number: 4,599,974

[45] Date of Patent: Jul. 15, 1986

[54] COMBUSTION CHAMBER FOR A VAPOR GENERATOR

[75] Inventor: Karl Rees, Ruti, Switzerland

[73] Assignee: Sulzer Brothers Limited, Winterhur, Switzerland

[21] Appl. No.: 640,977

[22] Filed: Aug. 15, 1984

[30] Foreign Application Priority Data

Aug. 23, 1983 [CH] Switzerland ..... 4579/83

[51] Int. Cl.[4] ..... F22B 15/00

[52] U.S. Cl. ..... 122/235 P; 431/176; 431/175

[58] Field of Search ..... 431/173, 179, 180, 178, 431/177, 176, 174, 175; 122/8, 10, 41, 235 C, 235 P, 333, 236, 25; 126/350 R

[56] References Cited

U.S. PATENT DOCUMENTS

| | | | |
|---|---|---|---|
| 2,216,117 | 10/1940 | Krug | 122/235 P |
| 2,268,603 | 1/1942 | Linder | 431/176 X |
| 2,730,998 | 1/1956 | Birkner | 122/235 P |
| 2,883,948 | 4/1959 | Seidl | 431/176 |
| 3,332,402 | 7/1967 | Rusanowsky et al. | 122/235 P |
| 4,368,031 | 1/1983 | Chadshay | 431/175 X |

FOREIGN PATENT DOCUMENTS

| | | | |
|---|---|---|---|
| 878289 | 8/1971 | Canada | 431/176 |
| 1130310 | 9/1956 | France | 122/235 P |

*Primary Examiner*—Randall L. Green

*Attorney, Agent, or Firm*—Kenyon & Kenyon

[57] ABSTRACT

A combustion chamber is subdivided vertically into layers with each layer having sets of burners disposed in angular spaced apart relation. In addition, the sets of burners are offset from one layer to another and all of the jet axes of the burners are directed in the same direction tangentially of a vertically disposed imaginary cylinder within the combustion chamber. The jets create a vortex flame within the combustion chamber.

13 Claims, 2 Drawing Figures

COMBUSTION CHAMBER FOR A VAPOR GENERATOR

Figure 1:
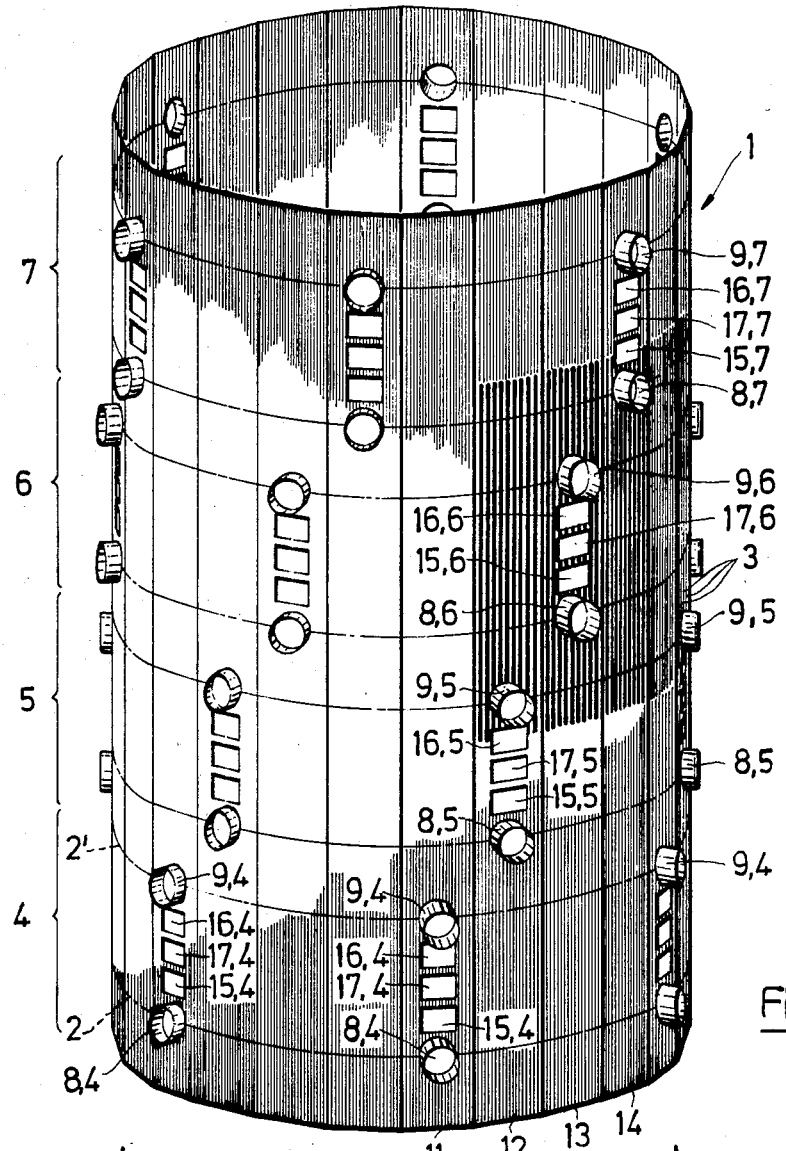

This invention relates to a combustion chamber. More particularly, this invention relates to a combustion chamber for a vapor generator.

Heretofor, it has been known to construct combustion chambers for vapor generators of wall tubes which extend basically in parallel relationship to a longitudinal axis of the combustion chamber for carrying a working medium. In addition, it has been known to divide the combustion chamber transversely of the longitudinal axis into at least two burner layers, each of which contains at least two burners situated basically in the same plane which extends transversely of the longitudinal axis of the combustion chamber. In many cases, each burner has a jet axis of the flame extending tangentially to a circle which is concentric with the longitudinal axis of the combustion chamber, with the flames of all the burners acting on the respective circles in the same direction of rotation. Usually, the jet axes of the burners in a given layer include an angle which is of equal magnitude for the burners of the other burner layers.

In the past, a combustion chamber of this type has had the burners of different layers disposed on the same combustion chamber generatrix. As a result, the same wall tubes which extend through the combustion chamber wall encounter a plurality of burners which are situated on the same generatrix in different layers. Hence, the wall tubes have to be passed around each of the burners in some fashion. In comparison with tubes which extend rectilinearly in the combustion chamber wall, this gives very different working medium flows. Hence, the working medium flowing in the wall tubes extending around the burners has a different heat absorption as compared with the working medium flowing in the rectilinear wall tubes. Consequently, the working medium has very different conditions where the medium leaves the combustion chamber. Accordingly, complex stuctural requiredments are needed to even out these differences in condition.

Accordingly, it is an object of the invention to provide an improved combustion chamber which achieves good uniformity of the conditions of a working medium passing from the combustion chamber.

It is another object of the invention to provide a combustion chamber for a vapor generator which is of relatively simple construction.

It is another object of the invention to provide a combustion chamber with an arrangement of burners which permits a uniform heat absorption by a working medium flowing through the wall tubes of the combustion chamber.

Briefly, the invention provides a combustion chamber for a vapor generator which is constructed of a plurality of wall tubes disposed in parallel to a longitudinal axis of the chamber for carrying a working medium therethrough. In addition, the combustion chamber has at least two burner layers disposed along the longitudinal axis with at least two burners disposed in each layer. Each burner is disposed in a common plane transverse to the longitudinal axis of the chamber and each burner has a jet axis for a flame extending in a common direction tangentially to an imaginary circle concentric to the longitudinal axis.

In accordance with the invention, each pair of adjacent burners in a respective burner layer has the jet axes thereof defining a first angle $\alpha$ therebetween. In addition, the jet axes of the burners of each layer are offset from the jet axes of an adjacent layer over a second angle $\beta$ projected parallel to the axis of the combustion chamber which is less than the first angle.

The offset arrangement of the burners from one layer to another means that a larger number of wall tubes which are distributed over the combustion chamber periphery have to be taken around a burner as compared to previously known constructions. However, on the other hand, this is required around fewer burners so that the effect of the disturbance to the heat absorption in the wall tubes affected is reduced. As a consequence, the differences in the conditions of the working medium at the outlet of the wall tubes from the combustion chamber are at a minimum. Further, it is possible for the working medium to be mixed in a simple, inexpensive manner after leaving the combustion chamber.

One advantage of the combustion chamber construction resides in an improvement in combustion conditions in the combustion chamber. In this regard, it is well known that the heat transfer at the walls of a combustion chamber of this kind is effected mainly by radiation in order to ensure that the available high temperatures are utilized without damaging the material of the wall tubes. It is also known that the burner arrangement wherein the jet axes of the flames leaving the burners are directed tangentially to circles concentric with the combustion chamber longitudinal axis, causes a rotating flame vortex which concentrates the hottest gases in the central region of the combustion chamber and makes this region an actual burner. This gives the following advantages:

(a) Uniform combustion as a result of good mixing of the combustion gases, so that even unburnt fractions of the air fuel mixture still leaving the burners or the flames thereof are completely burnt in the flame vortex.

(b) No markedly hot and cold zones.

(c) Good uniform heating of the walls of the combustion chamber by radiation, the combustion gases simply sweeping along the walls and not impacting them directly.

(d) The relative air and fuel proportions need not be set absolutely perfectly at each burner because uniform proportions are obtained as a result of the thorough mixing in the flame vortex, thus achieving good combustion despite a possible slight excess of air at some burners.

(e) Reduced $NO_x$-formation tendency.

The above-mentioned improvement of the combustion conditions of this known type of firing or tangential firing, by the inventive burner arrangement, is due to the fact that both the rotary movement of the flame vortex and the resulting thorough mixing and maintenance of the form of the flame vortex are assisted more satisfactorily. This is because the burner arrangement offset from one layer to another causes the flames issuing therefrom to be distributed over a plurality of points on the periphery of the flame vortex as they enter the vortex. The closer the combustion chamber approaches the cylindrical shape, the more significant the improvement provided.

The combustion chamber also has the advantage that its overall length is reduced because the effective distance between two adjacent burners in two consecutive burner layers is measured at an angle to the combustion chamber longitudinal axis so that the distance measured in the direction of the longitudinal axis less than the effective distance. This means considerable savings in material, manufacturing, transportation and assembly costs.

In order to increase the effectiveness of the combustion chamber and/or enable reserve burners to be incorporated at least one of said burner layers includes at least two additional burners which are disposed in a common plane and which are aligned with the other burners in the burner layer. These additional burners may also be constructed for firing with a different fuel from the other burners. This permits different fuels to be used for firing in the combustion chamber.

The wall tubes of the combustion chamber may be constructed to define a cylinder. This shape provides optimum combustion gas guidance and heat distribution over the wall tubes.

In another embodiment, the wall tubes may define an equilateral polygon. This shape provides a good combustion chamber which is also very advantageous with respect to manufacture, particularly for large vapor generator units. In this case, a polygon is preferred which has a number of sides which is divisible by as many other numbers as possible, for example, 6, 8, 12, 20 or 24 sides, because the total number of burners and the number of burners per burner layer can be very easily optimized. In this case also, each burner is disposed in the middle of a respective side of the polygon.

An optimum combustion chamber configuration is obtained where the product of the number of burners in each layer and the number of layers is at least equal to the number of sides of the polygon. This provides a combustion chamber which is of particular value in easing the manufacture of the chamber.

Figure 2:
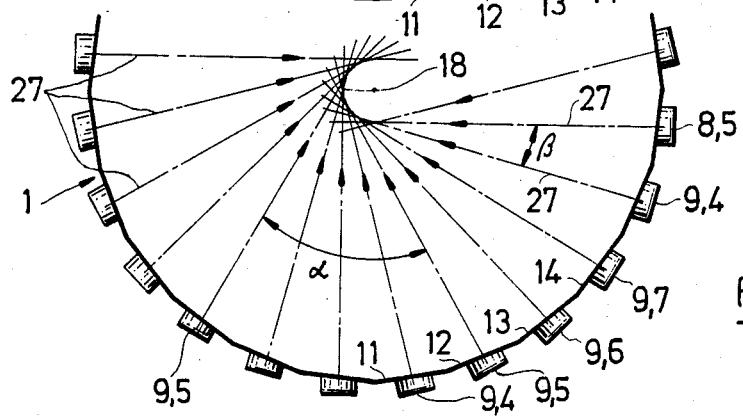

These and other objects and advantages of the invention will become more apparent from the following detailed description taken in conjunction with the accompanying drawings wherein:

FIG. 1 diagramatically illustrates a perspective view of a combustion chamber constructed in accordance with the invention; and FIG. 2 illustrates a partial plan view of the combustion chamber of FIG. 1.

Referring to FIGS. 1 and 2, the combustion chamber 1 is constructed for use in a vapor generator. As indicated, the combustion chamber has a plurality of wall tubes 3 which are disposed in parallel to a longitudinal axis of the chamber for carrying a working medium therethrough. These wall tubes 3 are welded together in gas-tight relationship in the longitudinal direction, preferably, with the interpositioning of webs (not shown).

As indicated in FIG. 1, the longitudinal axis of the combustion chamber 1 is disposed vertically while the wall tubes define an equilateral polygon having twenty four sides. In this respect, the combustion chamber 1 is intended for a vapor generator designed for an output of about 600 megawatts (MW). In addition, a gas flue (not shown) is connected to the top end of the combustion chamber.

The combustion chamber 1 is divided into four burner layers 4, 5, 6, 7 vertically along the longitudinal axis, i.e. transversely to the longitudinal direction. In addition, each layer has a plurality of sets of burners with each set being disposed in a respective side of the combustion chamber. As indicated, four of the combustion chamber sides are denoted by the reference characters 11, 12, 13, 14.

Referring to FIG. 1, each burner set in the lowermost layer 4 includes two ports 8, 4 and 9, 4 for diesel oil burners (not shown). The connection ports 8, 4 are situated in a common horizontal plane 2 which extends at a right angle to the combustion chamber longitudinal axis. The connection ports 9, 4 are also situated in a horizontal plane 2' located above the plane 2. A rectangular port 15, 4 for connection of a coal dust burner (not shown) is also formed in the wall 11 above the port 8, 4. A similar port 16, 4 is also provided in the wall 11 below the port 9, 4 while a port 17, 4 is provided between the ports 15, 4 and 16, 4 for the supply of intermediate air for the coal-dust burners.

The arrangement of ports 8, 4; 9, 4; 15, 4; 16, 4 and 17, 4 is repeated in the burner layer 4 in every fourth side starting from side 11. Hence, the burner layer 4 has a total number of six times the five ports. All of the ports 15, 4; 16, 4 and 17, 4 lie in planes which are parallel to the planes 2, 2', respectively.

The burner layer 5 is provided with a similar arrangement of burner sets in the side 12 offset the right, as viewed, from the chamber side 11. The ports in this burner layer 5 are denoted by reference characters 8, 5; 15, 5; 17, 5; 16, 5 and 9, 5. As indicated in FIG. 1, the ports are provided in the same arrangement in burner layer 5, i.e. in every fourth burner chamber side starting from side 12.

Burner layer 6 contains the same sequence of burner ports 8, 6; 15, 6; 17, 6; 16, 6 and 9, 6. This arrangement is also repeated six times uniformly over the periphery of the combustion chamber. In like manner, the top burner layer 7 contains six sets of burner ports 8, 7; 15, 7; 17, 7; 16, 7 and 9, 7.

The combustion chamber 1 thus contains a total of forty-eight cylindrical ports, each for a diesel oil burner, forty-eight rectangular ports for coal-dust burners and twenty-four rectangular ports for intermediate air.

As indicated in FIG. 1, when the burners are positioned in the respective ports, the sets of burners in each layer are angularly spaced from each other over a first angle while being angularly offset from the burner sets of an adjacent layer over a second angle which is less than the first angle.

Referring to FIG. 2, all of the ports are so arranged that each burner of a given layer has a jet axis 27 for a flame extending in a common direction, i.e. clockwise, as viewed, tangentially to an imaginary circle 18 which is concentric to the longitudinal axis of the combustion chamber. The imaginary circles of the various layers serve to define a vertical cylinder. As shown in FIG. 2, each pair of adjacent burners in a common horizontal plane have jet axes 27 which define an angle $\alpha$ therebetween. FIG. 2 indicates this angle is being disposed between two diesel oil burner ports 9, 5 of the second layer 5. In addition, the jet axes 27 of the burners of a layer are offset from the jet axes of an adjacent layer over an angle $\beta$—as considered in a projection parallel to the combustion chamber longitudinal axis —which is less than the angle $\alpha$.

As is apparent from FIG. 1, the ports 9, 4; 9, 5; 9, 6 and 9, 7 are situated basically on a helix because of the offset arrangement. The remaining ports are likewise disposed on parallel helices. Each of these helices is found six times on the outer surface of the combustion chamber 1. The points of intersection of the jet axes 27 on the cylindrical surface formed by the circles 18 are projections of the center-port points of the ports and are disposed on parallel helical lines in a similar manner.

Since the combustion chamber 1 is divided into four burner layers 4–7, each of the twenty-four sides contains just one row of five ports. For example, side 11 contains the row of ports 8, 4; 15, 4; 17, 4; 16, 4 and 9, 4. Further, each port for a burner is disposed in the middle of a respective side so that the wall tubes 3 in the central zone of the chamber side are taken only around this row of ports while the other wall tubes 3 of the side extend rectilinearly. Therefore, all the sides of the combustion chamber are subject to practically the same conditions with respect to heat absorption.

Since the wall tubes 3 which are taken around one row of ports in each case and the rectilinear wall tubes 3 are distributed uniformly over the periphery of the combustion chamber 1 the working medium flowing through the wall tubes can be mixed at the outlet of the combustion chamber 1 in a relatively simple manner, for example, in headers, in order to obtain a completely uniform condition of the working medium upon emerging.

Either diesel oil or coal dust can be used for firing in the combustion chamber 1. For diesel oil firing, the diesel oil burners connected to the corresponding ports 8, 4–8, 7 and 9, 4–9, 7 are ignited, while for small loads only the top or bottom burners in the layers 4–7 or possibly just some of the top and bottom burners are used. For coal-dust firing, coal-dust together with supporting air is injected through ports 15, 4; 16, 4; 15, 5; 16, 5, etc. while intermediate air is injected through ports 17, 4; 17, 5; 17, 6; and 17, 7 and top or bottom air is injected through the ports 8, 4; 8, 5; 8, 6 and 8, 7 and 9,4; 9, 5; 9, 6 and 9, 7, into combustion chamber 1. The initial ignition of this mixture is effected by means of the oil burners. Thus, for operation with coal dust, each row of five ports operates as a burner.

The flames leaving the individual burners extend as far as the middle region of the combustion chamber 1 where they meet substantially tangentially on the cylinder formed by the circles 18, induce turbulent flow in each other, and pass into the form of a thoroughly mixing flame vortex rotating in the clockwise direction and extending upwardly in the combustion chamber 1. In accordance with the arrangement of the burners in the combustion chamber surface, the individual flames meet the vortex over helical lines.

This arrangement is a basic feature of the combustion chamber 1. In the past, a plurality of burners were disposed over the same combustion chamber generatrix, i.e. directly one upon the other, so that vertical spaces were formed along the periphery of the flame vortex between the superimposed places of impingement of the individual flames. From these spaces, the combustion gases were moved towards the combustion chamber walls by centrifugal force. According to the invention, however, these spaces extend helically and are accordingly much narrower, and this contributes to holding the combustion gases together in the flame vortex.

Of course, the vertical speed of the combustion gases along the combustion chamber 1 and hence the quality of mixing of the gases can be decisively influenced by adjusting the burner inclination to the horizontal.

During firing, the combustion chamber 1 is cooled by the working medium flowing in the wall tubes 3, the working medium being supplied at the bottom end of the combustion chamber and coming, for example, from an economizer. At the top, the wall tubes 3 can be continued in the form of tubes of a gas flue.

The burners are fixed to the combustion chamber 1 in known manner. The connection between the combustion chamber 1 and the adjacent parts of the vapor generator is also effected in known manner.

Instead of rotating clockwise, the jet axes 27 may alternatively be so directed that the flame vortex rotates counter-clockwise.

The invention thus provides a combustion chamber wherein the working medium flowing through the wall tubes is exposed to heat transfer in a substantially uniform manner.

Further, the invention provides a combustion chamber which may have a shape and form of a cylinder or of an equilateral polygon. In this latter case, the product of the number of burners in each layer and the number of layers is at least equal to the number of sides in the polygon.

What is claimed is:

1. A combustion chamber for a vapor generator, said chamber comprising a plurality of wall tubes welded together to form a gas tight wall and disposed in parallel to a longitudinal axis of the chamber for carrying a working medium therethrough;

at least three burner layers disposed along said longitudinal axis;

at least two burners disposed in each said burner layer, said burners being disposed in a common plane transverse to said longitudinal axis with each burner having a jet axis for a flame extending in a common direction tangentially to an imaginary circle concentric to said axis; and each pair of adjacent burners in a respective layer having the jet axes thereof defining a first angle therebetween and said jet axes of said burners of each layer being offset from said jet axes of an adjacent layer over a second angle projected parallel to said longitudinal axis less than said first angle whereby said burners extend on a helix about said longitudinal axis.

2. A combustion chamber as set forth in claim 1 wherein at least one of said burner layers includes at least two additional burners disposed in a common plane and aligned with the other burners in said layer.

3. A combustion chamber as set forth in claim 2 wherein said additional burners are constructed for firing with a different fuel from said other burners.

4. A combustion chamber as set forth in claim 1 wherein said wall tubes define a cylinder.

5. A combustion chamber as set forth in claim 1 wherein said wall tubes define an equilateral polygon.

6. A combustion chamber as set forth in claim 5 wherein each burner is disposed in the middle of a respective side of said polygon.

7. A combustion chamber as set forth in claim 6 wherein the product of the number of burners in each layer and the number of layers is at least equal to the number of sides in said polygon.

8. A combustion chamber comprising a plurality of wall tubes welded together to form a gas tight wall and disposed in parallel to a vertical longitudinal axis for carrying a working medium therethrough;

at least three burner layers vertically disposed along said axis;

at least two burners disposed in each burner layer in a common horizontal plane, each burner having a jet axis for a flame extending in a common direction tangentially to an imaginary circle concentric to said axis; and each pair of adjacent burners in a respective layer having the jet axes thereof defining a first angle therebetween and said jet axes of said burners of each layer being offset from said jet axes of an adjacent layer over a second angle projected parallel to said longitudinal axis less than said first angle whereby said burners extend on a helix about said longitudinal axis.

9. A combustion chamber as set forth in claim 8 wherein said tubes define an equilateral polygon.

10. A combustion chamber as set forth in claim 9 wherein each burner is disposed in a respective side of said polygon.

11. A combination chamber comprising a plurality of wall tubes welded together to form a gas tight wall disposed in parallel to a vertical longitudinal axis for carrying a working medium therethrough;

at least three burner layers vertically disposed along said axis;

at least two sets of burners disposed in each burner layer, each set of burners including a first burner disposed in a first common horizontal plane with a first burner of the other burner sets and at least a second burner disposed in a second common horizontal plane with a second burner of the other burner sets;

each burner having a jet axis for a flame extending in a common direction tangentially to an imaginary circle concentric to said axis; and said sets of burners in each layer being angularly spaced from each other over a first angle while being angularly offset from said burners of an adjacent layer over a second angle less than said first angle whereby said sets of burners extend on a helix about said longitudinal axis.

12. A combustion chamber as set forth in claim 11 wherein said tubes define an equilateral polygon.

13. A combustion chamber as set forth in claim 12 having four burner layers with each set of burners being disposed in every fourth side of said polygon.

* * * * *

UNITED STATES PATENT AND TRADEMARK OFFICE

CERTIFICATE OF CORRECTION

PATENT NO. : 4,599,974

DATED : July 15, 1986

INVENTOR(S) : Karl Rees

It is certified that error appears in the above-identified patent and that said Letters Patent is hereby corrected as shown below:

Column 1, line 41 "requiredments" should be - requirements-

Column 2, line 68 "axis less" should be -axis is less-

Column 7, line 13 "combination" should be -combustion-

Signed and Sealed this

Sixth Day of January, 1987

*Attest:*

DONALD J. QUIGG

*Attesting Officer*

*Commissioner of Patents and Trademarks*